US009955831B2

(12) United States Patent
Bilger

(10) Patent No.: US 9,955,831 B2
(45) Date of Patent: May 1, 2018

(54) SURFACE CLEANING APPARATUS WITH AN ADJUSTABLE HANDLE

(71) Applicant: SharkNinja Operating LLC, Needham, MA (US)

(72) Inventor: Dan Bilger, Amherst, NH (US)

(73) Assignee: SharkNinja Operating LLC, Needham, MA (US)

( * ) Notice: Subject to any disclaimer, the term of this patent is extended or adjusted under 35 U.S.C. 154(b) by 864 days.

(21) Appl. No.: 14/383,469

(22) PCT Filed: Mar. 8, 2013

(86) PCT No.: PCT/US2013/029849
§ 371 (c)(1),
(2) Date: Sep. 5, 2014

(87) PCT Pub. No.: WO2013/134630
PCT Pub. Date: Sep. 12, 2013

(65) Prior Publication Data

US 2015/0013102 A1 Jan. 15, 2015

Related U.S. Application Data

(60) Provisional application No. 61/608,899, filed on Mar. 9, 2012.

(51) Int. Cl.
*A47L 5/28* (2006.01)
*A47L 9/32* (2006.01)
(Continued)

(52) U.S. Cl.
CPC ..... *A47L 5/28* (2013.01); *A47L 9/325* (2013.01); *A47L 5/225* (2013.01); *A47L 9/242* (2013.01)

(58) Field of Classification Search
CPC ..... A47L 5/225; A47L 9/608; A47L 9/242; A47L 5/28
See application file for complete search history.

(56) References Cited

U.S. PATENT DOCUMENTS 4,393,536 A 7/1983 Tapp
9,591,953 B2 * 3/2017 Conrad ..... A47L 5/225
(Continued)

FOREIGN PATENT DOCUMENTS

EP 1 652 460 A1 5/2006

OTHER PUBLICATIONS

International Search Report and Written Opinion for PCT/US2013/029849 dated Aug. 23, 2013.
(Continued)

*Primary Examiner* — Michael Jennings
(74) *Attorney, Agent, or Firm* — Grossman Tucker Perreault & Pfleger, PLLC

(57) ABSTRACT

A reconfigurable upright surface cleaning apparatus may include a cleaning unit including an air treatment member, a suction motor and a clean air outlet. The cleaning unit may be detachably connected to the surface cleaning apparatus. A reconfigurable air flow passage may include at least one portion that is alternatively configurable between a surface cleaning mode and an auxiliary cleaning mode. An adjustable handle may be provided on the cleaning unit and may be drivingly connected to the surface cleaning head. The handle may include a grip portion having at least one grip member and may be moveable between an extended position, in which the grip portion is spaced apart from the cleaning unit, and a retracted position, in which the grip portion is positioned proximate the cleaning unit.

23 Claims, 6 Drawing Sheets

(51) Int. Cl.
*A47L 9/24* (2006.01)
*A47L 5/22* (2006.01)

(56) References Cited

U.S. PATENT DOCUMENTS

| | | | | |
|---|---|---|---|---|
| 2004/0134026 | A1 | 7/2004 | Brinkhoff et al. | |
| 2007/0245514 | A1 | 10/2007 | Luebbering et al. | |
| 2008/0244860 | A1 | 10/2008 | Gammack et al. | |
| 2009/0144929 | A1* | 6/2009 | Yoo | A47L 5/225 15/327.5 |
| 2009/0188997 | A1 | 7/2009 | Rosenzweig et al. | |
| 2011/0219573 | A1* | 9/2011 | Conrad | A47L 5/225 15/347 |
| 2012/0000030 | A1* | 1/2012 | Conrad | A47L 5/24 15/329 |
| 2017/0224179 | A1* | 8/2017 | Conrad | A47L 5/225 |

OTHER PUBLICATIONS

International Preliminary Report on Patentability for PCT/US2013/029849 dated Sep. 18, 2014.

* cited by examiner

SURFACE CLEANING APPARATUS WITH AN ADJUSTABLE HANDLE

RELATED APPLICATIONS

The present application is a national stage filing under 35 U.S.C. § 371 of international PCT application PCT/US2013/029849, filed Mar. 8, 2013, and entitled "SURFACE CLEANING APPARATUS WITH AN ADJUSTABLE HANDLE," which claims priority under 35 USC § 119(e) priority to U.S. Provisional Patent Application Ser. No. 61/608,899, filed Mar. 9, 2012, and entitled "SURFACE CLEANING APPARATUS WITH AN ADJUSTABLE HANDLE," each of which is incorporated herein by reference in its entirety.

FIELD

The present subject matter of the teachings described herein relates generally to surface cleaning apparatuses, such as vacuum cleaners.

BACKGROUND

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one broad aspect of the teachings described herein, a surface cleaning apparatus includes a surface cleaning head and an upper section mounted to the surface cleaning head. The surface cleaning apparatus includes a dirty air inlet, a clean air outlet and an air flow passage that extends therebetween. A suction motor and an air treatment member can be provided in the air flow passage between the dirty air inlet and the clean air outlet. Preferably, the suction motor, air treatment member and other operating components of the surface cleaning apparatus can be provided in a cleaning unit on the upper section. The upper section may be moveable between an upright position and an in use position. Optionally, the upper section can be detachable from the surface cleaning head.

The air flow passage may include an upflow conduit provided on the upper section. A portion of the upflow conduit may include a detachable cleaning wand, and may be operable in both a surface cleaning mode and an above floor cleaning mode. Preferably, the upflow conduit also includes a flexible hose member that fluidly connects the cleaning wand to the air flow passage. The flexible hose may allow a user to manipulate the cleaning wand separately from the upper section.

An advantage of this configuration may be that it allows a user to manipulate the upper section without having to manipulate the surface cleaning head. For example, a user may wish to separate the cleaning unit from the surface cleaning head and utilize the above floor cleaning wand to clean furniture, window covers, ceiling corners and any other such features. Detaching the surface cleaning head may allow a user to carry only the upper section, without requiring the user to lift the weight of the surface cleaning head.

A handle may be drivingly connected to the upper section. The handle may allow a user to manipulate the surface cleaning apparatus in the surface cleaning mode. The handle may also be used to carry the upper section when the upper section is separated from the surface cleaning head. The handle may include a grip portion that is graspable by a user. Preferably, the handle may be adjustable so that the grip portion can be moved between extended and retracted positions relative to the cleaning unit.

An advantage of this configuration may be that a user can change the height of the handle, and specifically the grip portion of the handle, relative to the cleaning unit and/or surface cleaning head. For example, a user may wish to place the handle in the extended configuration when using the surface cleaning apparatus as an upright vacuum cleaner in the surface cleaning mode. This may allow a user to push, pull or otherwise maneuver the surface cleaning apparatus along a surface. A user may wish to place the handle in, the retracted position when the upper section is detached from the surface cleaning head and is going to be carried by the user. Retracting the handle may reduce the overall height of the upper section, which may allow the user to hold the upper section by his/her side, without having to bend or otherwise elevate his/her arm. This may help reduce the stress placed on a user's arm.

A user may also wish to retract the handle in a plurality of other situations, and optionally, when the cleaning unit is mounted on the surface cleaning head. For example, a user may wish to adjust the height of the handle to accommodate his/her height, and/or if the surface cleaning head is being used on stairs or other surfaces at different elevations. Optionally, a user may wish to position the handle in the extended configuration when the cleaning unit is detached from the surface cleaning head. To help accommodate such desires, the handle may be configured so that it is moveable between the retracted and extended configurations regardless of the operating mode of the surface cleaning apparatus.

In accordance with this aspect, a reconfigurable upright surface cleaning apparatus may include a surface cleaning head having a first dirty air inlet and a cleaning unit including an air treatment member, a suction motor and a clean air outlet. The cleaning unit may be movably connected to the surface cleaning head and may be moveable between an upright storage position and an inclined in use position. The cleaning unit may be detachably connected to the surface cleaning apparatus. A reconfigurable air flow passage may include at least one portion that is alternatively configurable between a surface cleaning mode in which the cleaning unit is connected to the surface cleaning apparatus and an air flow passage extends between the first dirty air inlet and the clean air outlet, and an auxiliary cleaning mode in which the cleaning unit is detached from the surface cleaning apparatus. The air flow passage may extend from a second dirty air inlet to the clean air outlet and the position of the second dirty air inlet is adjustable relative to the cleaning unit. An adjustable handle may be provided on the cleaning unit and may be drivingly connected to the surface cleaning head. The handle may include a grip portion having at least one grip member and may be moveable between an extended position, in which the grip portion is spaced apart from the cleaning unit, and a retracted position, in which the grip portion is positioned proximate the cleaning unit.

The handle may include a telescoping handle.

The cleaning unit may have a length and the telescoping handle may include a telescopic handle shaft including an upper shaft portion slidably coupled to a corresponding channel portion. The channel portion may extend along at least a portion of the length of the cleaning unit.

When the grip portion is in the retracted position at least ⅔ of the upper shaft portion may extend along the length of the cleaning unit.

The handle may be selectably securable in both the extended and retracted positions.

The cleaning unit may be detachably connected to the surface cleaning head.

The grip portion may be moveable between the extended and retracted positions when the surface cleaning unit is in each of the surface cleaning mode and the auxiliary cleaning mode.

The grip portion may be securable in at least one intermediate position between the extended and retracted positions.

The air flow passage may include at least one re-positionable conduit member having a downstream end that is in continuous air flow communication with the air treatment member and an upstream end that defines the second dirty air inlet when the cleaning unit is in the auxiliary cleaning mode and that is in air flow communication with the first dirty air inlet when the cleaning unit is in the surface cleaning mode.

The re-positionable conduit member may include a flexible hose.

The downstream end of the re-positionable conduit member may be movably coupled to the cleaning unit and may be rotatably coupled to the cleaning unit.

The handle may not form part of the air flow passage.

The handle may extend from an upper portion of the cleaning unit and is external the air flow passage.

The handle may include a shaft member extending between the cleaning unit and the grip portion and the shaft member may be external the air flow passage The at least one grip member may include a first grip member and a second grip member spaced apart from the first grip member.

The first grip member may extend in a first direction and the second grip member may extend in a second direction that is at an angle to the first direction.

The second grip member may be oriented at an angle between about 10 degrees and about 175 degrees relative to the first grip member.

When the surface cleaning apparatus is in the upright position the second grip member may be generally vertical and the first grip member may be within about 30 degrees of horizontal.

The second grip may be provided on a rear portion of the handle and may generally vertical when the upper section is in the upright position.

DRAWINGS

Reference is made in the detailed description to the accompanying drawings, in which:

Figure 1:
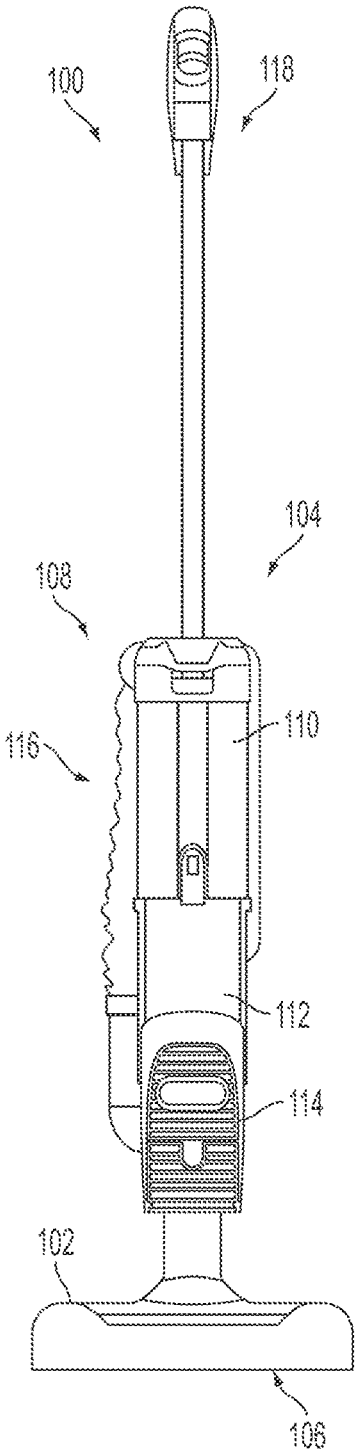
FIG. 1 is a front view of an example of a surface cleaning apparatus.

Where considered appropriate, reference numerals may be repeated among the figures to indicate corresponding or analogous elements.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Referring to FIG. 1, an embodiment of a surface cleaning apparatus is shown. In the embodiment illustrated, the surface cleaning apparatus 100 is an upright surface cleaning apparatus. In alternate embodiments, the surface cleaning apparatus may be another suitable type of surface cleaning apparatus, including, for example, a hand vacuum, a canister vacuum cleaner, a stick vac, a wet-dry vacuum cleaner and a carpet extractor.

As exemplified in FIGS. 1-4, a surface cleaning apparatus 100 is an upright vacuum cleaner that includes a surface cleaning head 102 and an upper section 104. A dirty air inlet 106 may be provided on the surface cleaning head 102. Optionally, the upper section 104 may be configured to include a cleaning unit 108 that contains at least an air treatment member 110 and a suction motor housing 112 containing a suction motor (not shown), and optionally a plurality of other components. Alternatively, the suction motor may be provided in any other suitable location.

Figure 7:
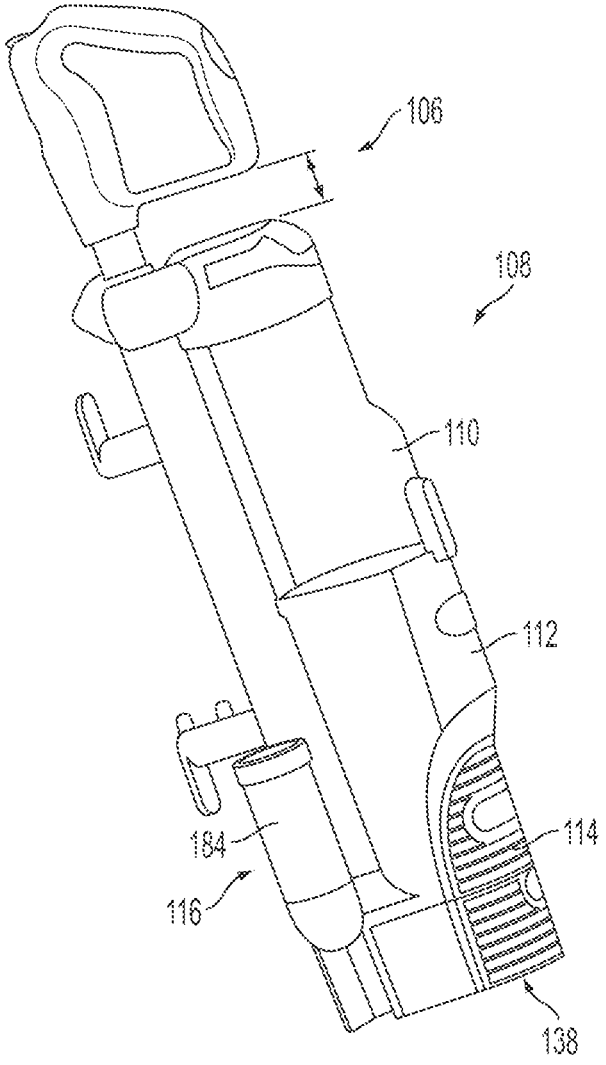
FIG. 7 is a perspective view of a portion of the surface cleaning apparatus of FIG. 1.
Figure 8:
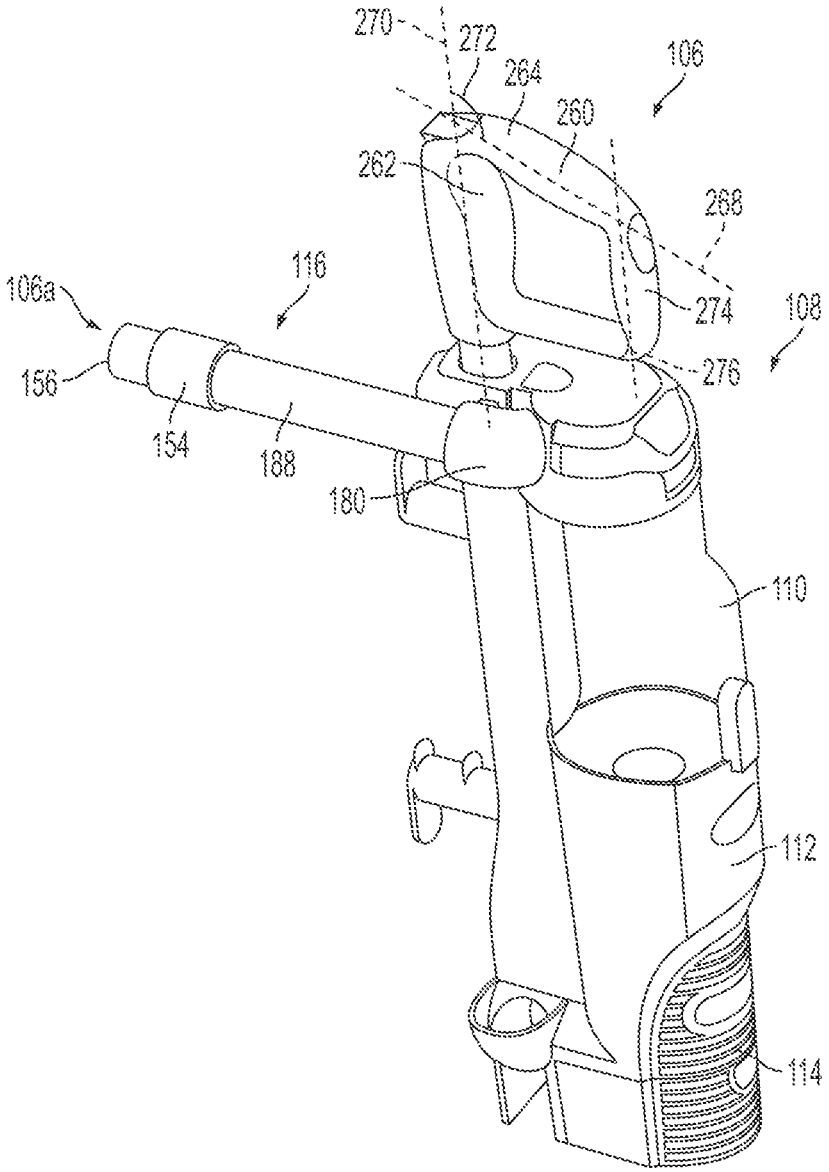
FIG. 8 is a perspective view of a portion of the surface cleaning apparatus of FIG. 1 with its air flow passage configured in a different configuration.

Optionally, the upper section 104, or at least a portion thereof, may be detachable from the surface cleaning head 102 (see for example FIGS. 7 and 8). Alternatively, the upper section may not be detachable from the surface cleaning head.

Preferably, the cleaning unit may include a clean air outlet 114, and an air flow passage 116 may extend between, and fluidly connect, the dirty air inlet 106 and the clean air outlet 114. While shown on the upper section, alternatively the clean air outlet may be provided in any other suitable location.

Optionally, the surface cleaning apparatus may be operable in more than one cleaning mode. The versatility of operating in different operating modes may be achieved in a plurality of ways, including, for example, by allowing the cleaning unit to be separated from the surface cleaning head. Alternatively, or in addition, further versatility may be achieved by permitting at least a portion of the upper section to be detached and/or reconfigured. For example, portions of the air flow passage provided on the upper section may be reconfigurable to alter the air flow passage.

For example, the surface cleaning apparatus 100 may be operable in a surface cleaning mode (see for example FIG. 1) in which the cleaning unit 108 is mechanically and fluidly connected to the surface cleaning apparatus 100 and the air flow passage 116 extends between the dirty air inlet 106 on the surface cleaning head 102 and the clean air outlet 114. The surface cleaning apparatus 100 may also be operable in an auxiliary cleaning mode in which the cleaning unit 108 is detached from the surface cleaning head 102 (see for example FIGS. 7 and 8). In the auxiliary cleaning mode the air flow passage 116 may extend from a different dirty air inlet (for example the inlet 106*a* of an auxiliary cleaning wand 154 or collar, an inlet of another cleaning tool or other suitable air inlet) to the clean air outlet 114. Preferably, in this configuration the position of the second dirty air inlet 106*a*, for example the end of a cleaning wand 154, is adjustable relative to the cleaning unit 108.

A handle 118 is preferably drivingly connected to the upper section 104 for manipulating the surface cleaning apparatus 100. The handle 118 may be of any suitable configuration that may be grasped by a user. While illustrated as being positioned toward the top of the upper section 104, the handle 118 may be provided at any other suitable location on the surface cleaning apparatus 100. When the surface cleaning apparatus 100 in its upright position, the vertical distance 120 between the bottom 122 of the surface cleaning head 102 and the top of the upper section 104, in this case the upper end 124 of the handle, defines a surface cleaning apparatus height 120. The height 120 may be any suitable distance, and may be between about one meter and two meters.

The surface cleaning head 102 may be any suitable type of cleaning apparatus, including, for example a powered cleaning head having a rotating brush and a brushless cleaning head. The surface cleaning head 102 may be of any suitable configuration and may include at least one wheel or other rolling support to contact the surface being cleaned.

In the illustrated example the surface cleaning head 102 includes a pair of rear wheels 126 and a pair of front wheels (optionally caster-type wheels, not shown) for rolling across a surface and the dirty air inlet 106 provided at the front end.

If the surface cleaning apparatus is an upright surface cleaning apparatus, then the upper section 104 may be moveably connected to the surface cleaning head 102 by any means known in the art. As exemplified in FIG. 6, optionally, the surface cleaning apparatus 100 may include a mounting hub 128 (of any suitable configuration) or other suitable structure, and the upper section 104 can be detachably mounted to the mounting hub 128. Preferably, the mounting hub 128 can be pivotally coupled to the surface cleaning head 102, using any suitable pivot joint, so that both the mounting hub 128 and the upper section 104 can be pivoted, for example about a pivot axis 130, relative to the surface cleaning head 102. Optionally, the upper section 104 can be rotatably coupled to the mounting hub 128, and/or at least a portion of the mounting hub 128 can be rotatable relative to the surface cleaning head 102, for example about a pivot axis 132. This configuration may allow the upper section 104 to be rotated relative to the surface cleaning head 102, at least when the surface cleaning apparatus 100 is in use. Preferably, the upper section 102 is at least moveable (e.g., pivotally mounted to the surface cleaning head) between an upright or storage position and an inclined in use position.

Optionally, the mounting hub 128 can be configured to provide connections for one or more services or components of the surface cleaning apparatus 100. This may allow a plurality of services, such as vacuum air flow and/or electrical power, to be transferred between the upper section 104 and the surface cleaning head 102 when the upper section 104 is mounted on the mounting hub 128. Preferably, the connections provided are configured so that they may be automatically engaged and/or disengaged by placement and removal of the upper section 104, respectively, without requiring a separate actuator or triggering mechanism. Alternatively, a plurality of switches, valves and other suitable hardware may be provided.

In the example illustrated, the upper section 104 comprises a cleaning unit 108 that includes an air treatment member 110 and a suction motor housing 112, which is preferably positioned below air treatment member 110. Alternatively, the upper section 104 may be of any suitable configuration.

The air treatment member 110 may be positioned in the air flow passage downstream from the dirty air inlet 106 to remove dirt particles and other debris from the air flowing through the air flow passage 116. The air treatment member 110 may be any suitable type of treatment member that includes any one or more of the features disclosed herein and may include, for example, a bag, a filter, one or more cyclones and any other apparatus that may help separate dirt from the air flowing through the air flow passage 116. In the illustrated example, the air treatment member is a cyclone bin assembly 110.

The clean air outlet 114 may be provided in the cleaning unit 108 and may be positioned downstream from the suction motor. Optionally, one or more filters or filtration members, for example a HEPA filter, may be provided at the clean air outlet 114. A grill 152 (FIG. 5), or other suitable cover member, may be provided at the clean air outlet 114 to help contain any such filters. Optionally, the grill 152 may openable, or preferably detachable, to allow access to the filter at the clean air outlet 114.

Optionally, the cleaning unit 108 may be configured as a generally self-contained unit or pod that is detachable from the surface cleaning head 102. In this configuration, the cleaning unit 108 is preferably configured to contain at least the air treatment member 110 and suction motor and may be re-configured to provide an auxiliary dirty air inlet in the communication with the air treatment member 110.

For example, the upper portion 104 may include a detachable portion that may function as an above-floor cleaning wand 154 and/or may be connectable to any other suitable auxiliary cleaning tool. As exemplified in FIG. 8, the cleaning wand 154 may be a relatively short conduit member and may have an inlet 156 that may be detached or separated from the cleaning unit 108 and serve as an auxiliary dirty air inlet 106*a*. In this configuration, the cleaning unit 108 may be operated as a stand-alone cleaning apparatus when it is separated surface cleaning head 102. For example, a user may wish to separate the cleaning unit 108 from the surface cleaning head 102 and utilize the above floor cleaning wand 154 to clean furniture, window covers, ceiling corners and any other such features. Detaching the surface cleaning head 102 may allow a user to carry only the cleaning unit 108, without requiring the user to lift the weight of the surface cleaning head 102.

Figure 6:
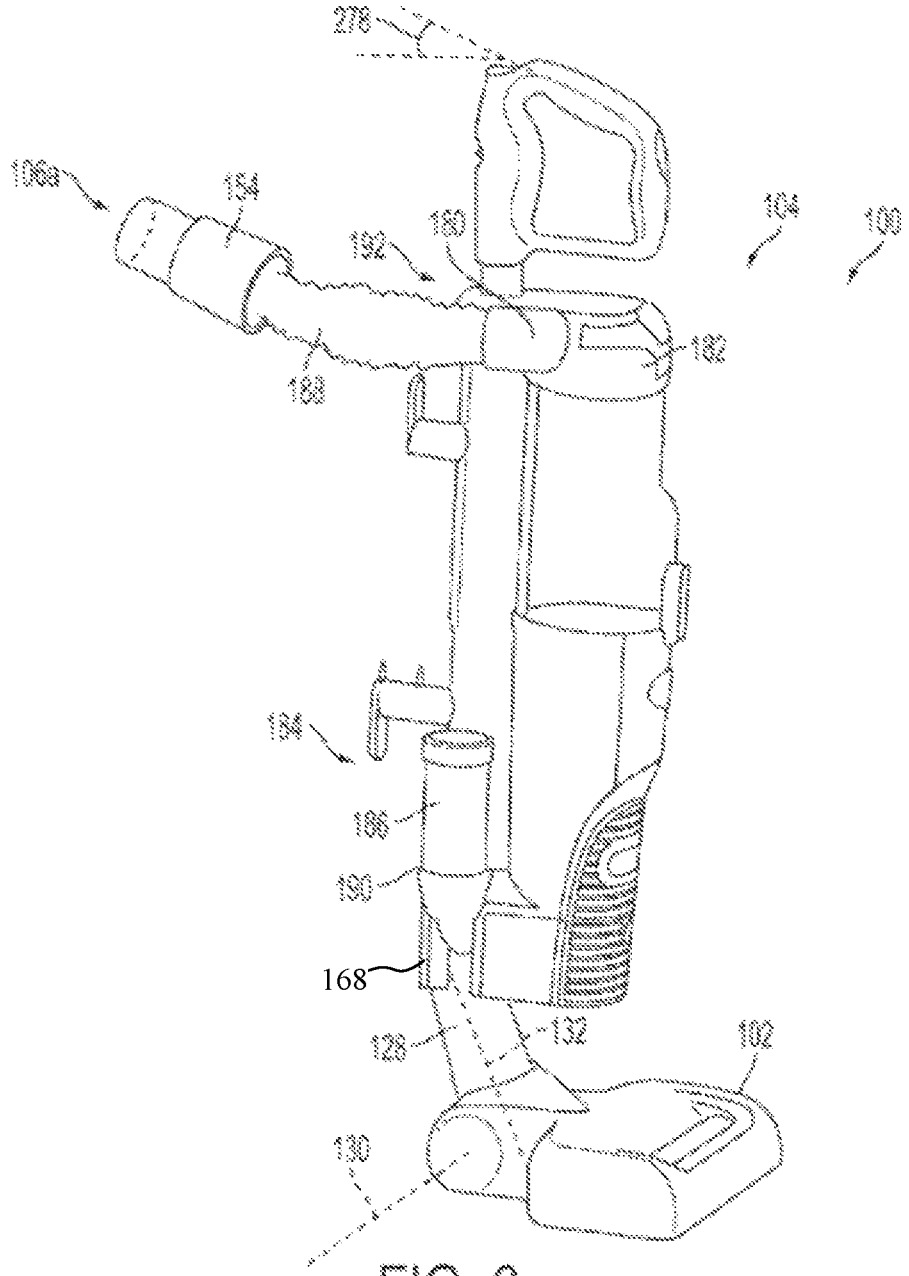
FIG. 6 is a side perspective view of the surface cleaning apparatus of FIG. 5.

Alternatively, as exemplified in FIG. 6, a user may wish to detach and use the cleaning wand 154 when the surface cleaning head 102 is still attached to the cleaning unit 108.

This may allow the cleaning unit 108 to be supported on the surface cleaning head 102 while a user manipulates the cleaning wand 154.

Figure 5:
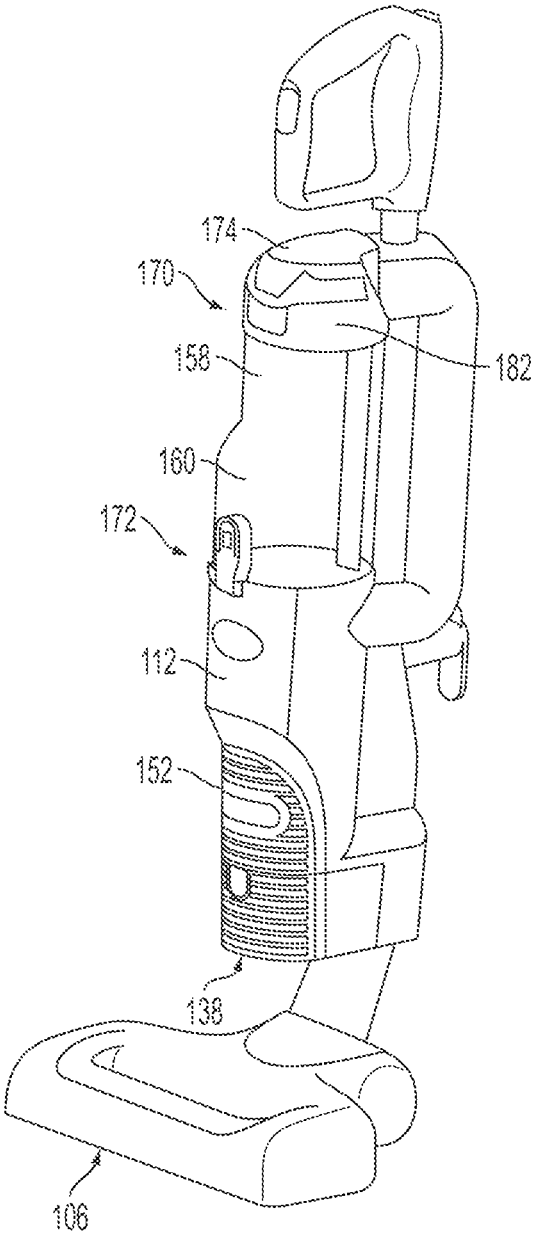
FIG. 5 is a front perspective view of the surface cleaning apparatus of FIG. 1 with the handle in a third position.

In the illustrated example, the air treatment member includes a cyclone bin assembly 110 having a cyclone chamber 158 and a dirt collection chamber 160. Referring also to FIG. 5, in the illustrated example the suction motor housing 112 is configured to house a suction motor (not shown). Preferably, as exemplified, the suction motor may be in air flow communication with the air flow passage 116, downstream from the cyclone bin assembly 110. The suction motor may be any suitable motor and may be selected based on a plurality of factors including, for example, suction strength, operating noise, power consumption and physical size. The housing 112 may be formed to accommodate the selected suction motor as well as mating with and optionally supporting the cyclone bin assembly 110.

Preferably, the cleaning unit 108 may be configured so that the cyclone bin assembly 110 is provided toward one end of the cleaning unit, the top or upper portion as illustrated in FIG. 5, and the suction motor may be provided toward the other end of the cleaning unit, i.e. toward the bottom or lower portion of the cleaning unit 108.

Optionally, a lower surface 138 (see for example FIGS. 5 and 7) of the cleaning unit 108 may include one or more support members configured to rest on the floor, or other such surface, when the cleaning unit 108 is detached from the surface cleaning head 102. For example, a user may wish to rest the cleaning unit 108 on the floor next to an object that is being cleaned, for example a given piece of furniture, rather than holding the cleaning unit 108 during the entire cleaning process. Providing support members on the cleaning unit 108 may help improve the stability of the cleaning unit 108 and may help protect portions of the cleaning unit from impact and/or damage. The support members may include one or more support feet extending from the cleaning unit 108. Optionally, the support feet may be integrally formed with the cleaning unit 108, or may be provided as separate members that may be attached to the cleaning unit 108.

Optionally, the support members may include at least one wheel or other type of rolling support member in addition to, or as an alternative to the support feet. Providing at least one rolling support member may allow the cleaning unit 108 to roll across the floor without the need for mounting the cleaning unit 108 on the surface cleaning head 102. This configuration may allow a user to roll the cleaning unit 108 across the floor, instead of lifting it, and/or may allow the cleaning unit 108 to be pulled along behind a user when in use.

When the cleaning unit 108 is mounted on the surface cleaning head 102, the cleaning unit support members, for example feet 168, may be at least partially nested within or otherwise accommodated by the mounting hub 128, or may be external the mounting hub 128.

The cyclone bin assembly 110 may be of any suitable design. For example, the cyclone bin assembly may be of any suitable configuration, size and shape. The cyclone chamber therein may be configured in a plurality of different configurations, including, for example, an upright cyclone, an inverted cyclone and a horizontal or transverse cyclone, and optionally may include more than one cyclones. As exemplified in FIG. 5, in the illustrated example, the cyclone bin assembly 110 includes cyclone chamber 158, configured as an inverted cyclone chamber, and a dirt collection chamber 160 disposed below the cyclone chamber 158. Preferably, the dirt collection chamber 160 may be configured to cooperate with the cyclone chamber 158, as well as connect with the rest of the surface cleaning apparatus 100. The cyclone chamber 158 may be integrally formed with the dirt collection chamber 160, or optionally may be separable from the dirt collection chamber 160.

Preferably, at least a portion of the cyclone bin assembly 100 is removable from the upper section 104 of the surface cleaning apparatus 100 to help facilitate emptying of the dirt collection chamber 160. More preferably, the entire cyclone bin assembly 110 is detachable from the cleaning unit 108. To help facilitate emptying and/or inspection at least one of, or both of the top 170 and bottom 172 of the cyclone bin assembly 110 may be openable to provide access to the interiors of the cyclone chamber 158 and/or the dirt collection chamber 160.

Optionally, some or all of the cyclone bin assembly 110 may be formed from a transparent or semi-transparent material, such as plastic, so that a user may visually inspect the contents of the cyclone bin assembly 110, for example the contents of the dirt collection chamber 160, without having to open or disassemble the cyclone bin assembly 110. This may also allow a user to inspect the interior of the cyclone bin assembly 110 while the surface cleaning apparatus 100 is in use.

Preferably a lid 174 (FIG. 5) covers the top 170 of the cyclone chamber 158. Optionally, an inner surface of the lid 174 may form the first or upper end wall of the cyclone chamber 158. Preferably, the lid 174 is openable and/or detachable from the cyclone bin assembly 110 by any means known in the art.

Opening the lid 174 may allow a user to access the interior of the cyclone chamber 158, for example for cleaning.

Preferably, a tangential air inlet 180 is provided in the sidewall 182 of the cyclone chamber 158 and is in fluid communication with the dirty air inlet 106, or 106*a*. The tangential air inlet 180 may be of any suitable design and/or cross sectional area and may be provided at any suitable location along the sidewall 182 of the cyclone chamber 158. Air flowing into the cyclone chamber 158 via the air inlet 180 may circulate around the interior of the cyclone chamber 158 and dirt particles and other debris may become disentrained from the circulating air.

The dirt collection chamber 160 may be provided to receive and retain dirt and debris that is separated from the dirty air flow via the cyclone chamber 158. The dirt collection chamber 160 may be any suitable configuration that may accommodate a given cyclone chamber 158, and may be formed from any suitable material, including, for example plastic and metal. At least a portion of the air circulating within the cyclone chamber 158 may flow into and circulate within the dirt collection chamber when the cyclone bin assembly is in use. After having circulated within the dirt collection chamber 160, the air may flow back into the cyclone chamber 158 and exit via the air outlet (not shown) of the cyclone chamber 158.

Optionally, the dirt collection chamber 160 may be a unitary, integrally formed chamber and/or may be of any suitable cross-sectional shape, and may have a varying cross-sectional shape along its height.

An air flow passage 116 extends from the dirty air inlet 106 and/or 106*a* to a clean air outlet 114, which is preferably provided on the upper section 104. The air flow passage 116 may include any suitable combination of rigid conduits, flexible conduits, chambers and other features that may cooperate to direct a flow of air through the surface cleaning apparatus. The upper section 104 may be of various configurations and the air flow passage 116 may be configured to travel in a plurality of different routes within and/or around the upper section 104 and/or cleaning unit 108.

Preferably, the air flow passage 116 is a re-configurable air flow passage that may be positioned in at least two different operating configurations.

Preferably, the air flow passage 116 includes at least one flexible conduit section. Providing a flexible conduit section may help facilitate re-configuration of the air flow passage. Optionally, the flexible conduit section may be positioned between two generally rigid conduit sections. Preferably, the flexible conduit section may include at least one flexible hose. Alternatively, the air flow passage may include any suitable combination of conduit members.

Preferably, at least one of the conduit sections is provided on the cleaning unit 108, and optionally may be at least partially integrally formed with the cleaning unit 108. Alternatively, all of the air flow conduit portions may be external to the cleaning unit 108.

As exemplified in FIGS. 6 and 8, in the illustrated example, a portion of the air flow passage 116 provided in the upper section 104 includes an upflow conduit 184, having fixed portion and a re-configurable portion. In this example, the fixed portion is a rigid conduit member 186 and the re-configurable portion is a flexible hose 188. In some other Figures, the hose 188 is not illustrated.

In this configuration, when the cleaning unit 108 is mounted on the surface cleaning head (FIGS. 5 and 6), dirty air may be drawn in via the dirty air inlet 106 and may flow through the surface cleaning head 102 and into an upstream end 190 of the first upflow conduit 184 (see FIGS. 3 and 6) and travel to an opposed downstream end 192 of the upflow conduit 184. In the illustrated example, the downstream end 192 of the upflow conduit 184 is provided proximate the upper end of the cleaning unit 108 and the handle 118 extending therefrom.

From the upflow conduit 184, the dirty air may travel into the air inlet 180 of the cyclone bin assembly 110 (or other suitable air treatment member). In this configuration, the air flow passage 116 includes at least one fixed portion and at least one re-positionable portion, for example conduit 188. The air flow passage 116 may also include any other suitable conduit sections as desired.

The cleaning wand 154 may be a generally rigid conduit member that is affixed to the upstream end of the hose 188. To establish an air flow passage from the inlet 106 to the air outlet 114, the inlet 156 of the cleaning wand 154 may be coupled to the downstream end of the rigid conduit member 186. The cleaning wand 154 may be of any suitable length. Optionally, the cleaning wand 154 may be configured as a mounting collar that may be used to connect to other auxiliary cleaning tools, including, for example, a longer wand segment, a crevice tool, a turbo brush and other tools.

In the illustrated example, the inlet 106*a* of the cleaning wand 154 may be detachably connected to the cleaning unit 108 using any suitable mechanism, and may be held in place using any suitable fastener, such as a releasable latch. When in this position, the cleaning wand 154 may form part of the air flow passage 116 connecting the dirty air inlet 106 to the clean air outlet 114 and may be drivingly connected to the surface cleaning head 102. Preferably, the inlet 106*a* of the cleaning wand 154 may be detached from the cleaning unit 108 when the cleaning unit is mounted on the surface cleaning head (FIG. 6), and when the cleaning unit 108 is separated from the surface cleaning head 102 (FIG. 8).

Optionally, the downstream end 192 of the re-positionable conduit member (e.g hose 188) may be movably and/or rotatably coupled to the cleaning unit 108 using any suitable connector, including, for example an elbow connector and a rotatable coupling member. Preferably, the rotatable or otherwise moveable connection may be provided between the downstream end 192 of the upflow conduit 184 and the air inlet 180. This may help facilitate re-configuration of the surface cleaning apparatus 100 and may make it easier to manipulate the hose 188.

Alternatively, or in addition, there may be one or more additional separation points or junctures in the air flow passage, and optionally, within the upflow conduit 184 portion. Additional detachment points may be provided along the length of upflow conduit 184 and at any other suitable position within the air flow passage 116.

Preferably, the hose 188 is at least somewhat extensible so that it may be stretched to provide some extra length when the cleaning wand 154 is in use, and, may retract to a shorter length when the cleaning wand 154 is mounted on the cleaning unit 108.

Optionally, when the cleaning wand 154 is detached from the cleaning unit 108, the connection between the downstream end 196 of the hose 188 and the upstream end 198 of the second upflow conduit 186 may provide the only mechanical and/or structural connection between the cleaning wand 154 and flexible hose 188 and the cleaning unit 108.

The handle 118 on the upper section 104 may be any suitable type of handle that may be gripped by a user.

Optionally, the handle 118 may be grippable in more than one direction. This may allow the user to grip the handle in one direction when operating the surface cleaning apparatus in surface cleaning mode (for example FIG. 1), and in a second direction when operating the surface cleaning apparatus in the auxiliary cleaning mode (for example FIGS. 6 and 8). This configuration may allow a user to comfortably operate the surface cleaning apparatus 100 in both operating modes. It may also give the user increased freedom when operating in the auxiliary cleaning mode, as the user may orient the handle 118, and cleaning wand 154 extending therefrom, in multiple orientations relative to the user's arm.

Preferably, the handle 118 may have a grip portion 282 that includes at least two separate grip members 260 and 262 that are spaced apart from each other to help provide at least two discrete grippable locations. Optionally, the handle 118 may include an outer (or optionally internal) support member 264 and the grip members 260 and 262 may be provided on the outer support member 264.

The grip members 260 and 262 may be formed from any suitable material, including relatively soft foam-like or gel-like materials that may help improve user comfort. Optionally, the grip members 260 and 262 may be integrally formed with the outer support member 264. Alternatively, the grip members 260 and 262 may be provided as separate members that may be coupled to the outer support using any suitable fasteners, including, for example, screws.

Optionally, the grip members 260 and 262 may be integrally formed with each other as part of a continuous insert member that may be coupled to the outer support member 264.

Preferably, the first grip member 260 may be generally linear and may be oriented in a first direction, along a first grip axis 268. The second grip member 262 may also optionally be generally linear and may be oriented in a different, second direction along a second grip axis 270. Optionally, the angle 272 between the first and second grip members may be between about 10 and about 175 degrees, and may be between about 85 and about 120 degrees.

Optionally, the handle 118 may include more than two grip members. For example a third grip 274 member may be provided on the handle 118 and may extend along a third axis 276. Preferably, the third axis 276 may be generally parallel to, and offset from, the second axis 270 and may be oriented at an angle to the first axis 268. Alternatively, the third axis 276 may be oriented at an angle to both the first and second axes 268 and 270.

In the illustrated example, when the surface cleaning apparatus is in the upright position, the second grip member 262 and third grip member 274 are in a generally upright position (e.g. within about 10 degrees of vertical) and the first grip member 260 is at an angle 278 to a horizontal plane (FIG. 6). Preferably, the angle 278 may be between about 0 and about 30 degrees. Preferably, the second grip 262 is positioned so that it is provided toward the back of the handle 118, the first grip 260 is provided toward the top of the handle 118 and the third grip 274 is provided toward the front of the handle. Alternatively, the grips may be provided at another suitable position.

In this example, the handle 118 does not form part of the air flow passage and includes a structural shaft 280 (FIGS. 2 and 3) that extends from the grip portion 282 to the cleaning unit 108. The shaft 280 may be any suitable structural or load bearing member that may be used to drivingly connect the grip portion 282 to the cleaning unit 108. It may be hollow or solid. Optionally, the shaft 280 may be formed from the same material as the grip portion 282, and preferably may be integrally formed therewith. Alternatively, the shaft 280 may be formed separately from the grip portion 282 and may be coupled to the grip portion 282 using any suitable fasteners, including, for example screws, bolt and pins. The handle 118 may be formed from any suitable material, including, for example plastic and metal.

Optionally the handle, or at least a portion thereof, may be adjustable (or otherwise re-configurable) so that the grip portion may be moveable between at least two different positions, for example between an extended position and a retracted position. This may allow a user to place the handle in one position when operating the surface cleaning apparatus in a first cleaning mode (for example the surface cleaning mode), and in another position when operating the surface cleaning apparatus in a second cleaning mode (for example the auxiliary cleaning mode).

For example, a user may wish to place the handle in the extended configuration when using the surface cleaning apparatus as an upright vacuum cleaner in the surface cleaning mode. This may allow a user to push, pull or otherwise maneuver the surface cleaning apparatus along a surface. A user may wish to place the handle in the retracted position when the upper section is detached from the surface cleaning head and is going to be carried by the user. Retracting the handle may reduce the overall height of the upper section, which may allow the user to hold the upper section by his/her side, without having to bend or otherwise elevate his/her arm. This may help reduce the stress placed on a user's arm.

A user may also wish to retract the handle in a plurality of other situations, and optionally, when the cleaning unit is mounted on the surface cleaning head. For example, a user may wish to adjust the height of the handle to accommodate his/her height, and/or if the surface cleaning head is being used on stairs or other surfaces at different elevations. Optionally, a user may wish to position the handle in the extended configuration when the cleaning unit is detached from the surface cleaning head. To help accommodate such desires, the handle may be configured so that it is moveable between the retracted and extended configurations regardless of the operating mode of the surface cleaning apparatus.

Optionally, the handle 118 may be locked or otherwise secured in both the extended and retracted configurations so that the handle may be drivingly connected to the cleaning unit and may also be used to lift the cleaning unit, without unintentionally changing the configuration of the handle. In some configurations, the handle may be lockable or securable in one or more intermediate or partially-retracted configurations, in which the grip portion 282 is positioned intermediate the extended and retracted positions. This may provide a greater variety of positions to accommodate a user's preferences.

Preferably, when the grip portion is in the extended position it, and the grip members provided thereon, may be spaced from the cleaning unit. In the retracted position, the grip portion, and grip portions provided thereon, may be positioned proximate the upper end of the cleaning unit 108.

The handle may include any suitable adjustment mechanism that is configurable to facilitate adjustment and repositioning of the grip portion, including, for example, a telescoping handle portion, a detachable handle portion, a handle portion that is slidable or moveable relative to the upper section and other suitable mechanisms.

Figure 2:
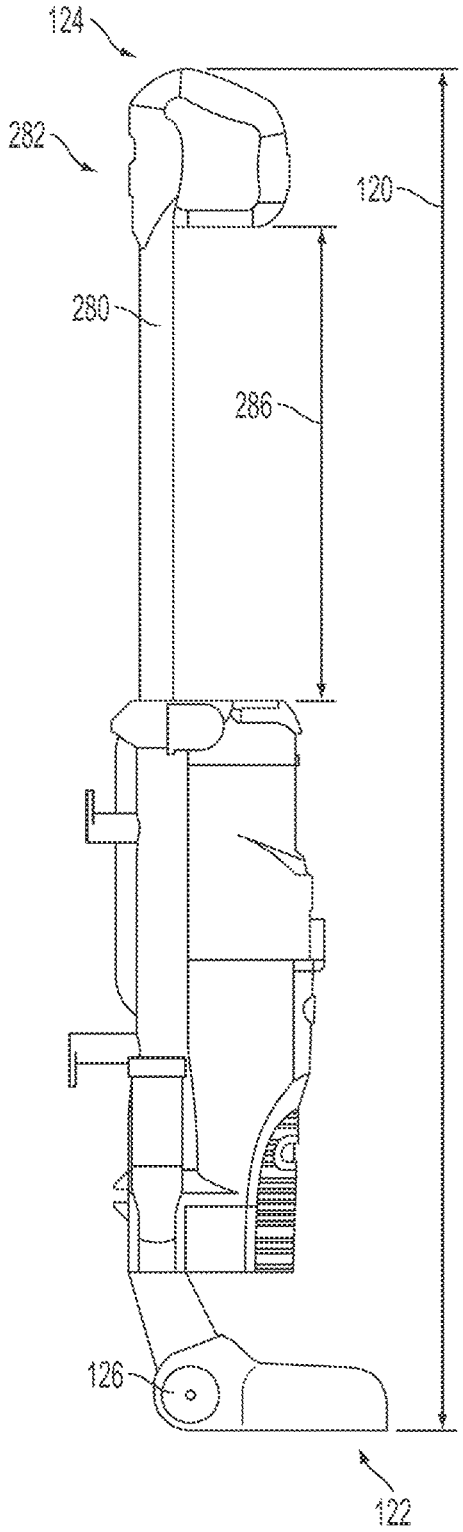
FIG. 2 is a side view of the surface cleaning apparatus of FIG. 1.
Figure 3:
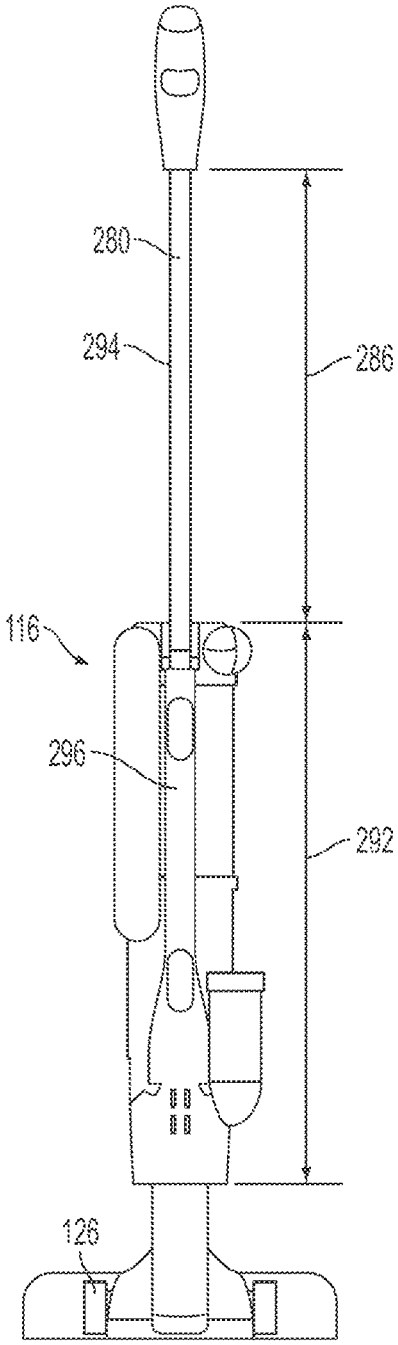
FIG. 3 is a back view of the surface cleaning apparatus of FIG. 1.
Figure 4:
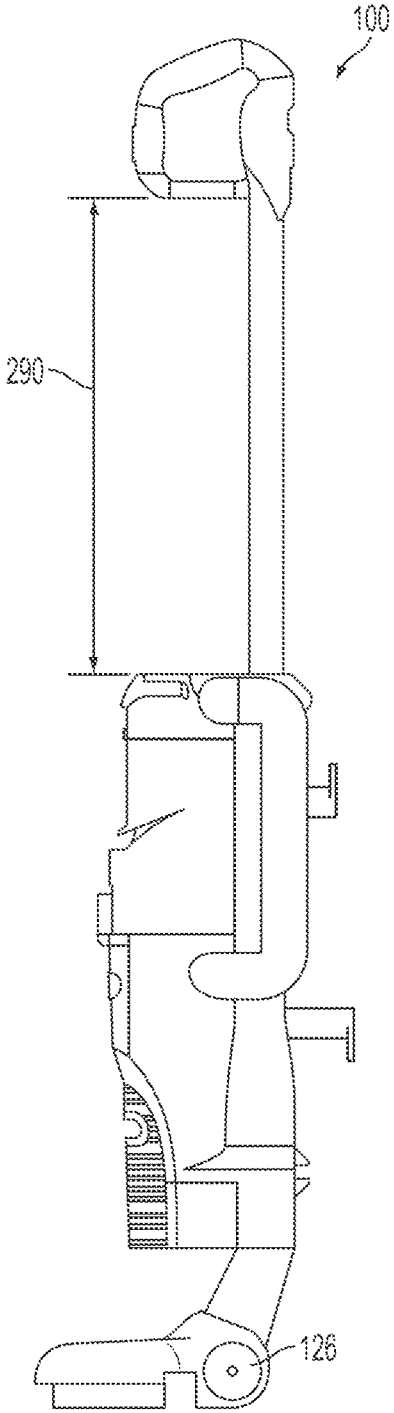
FIG. 4 is a side view of the surface cleaning apparatus of FIG. 1 with the handle in a second position.

As exemplified in FIGS. 2, 6 and 7, in the illustrated example the handle 118 is an adjustable handle and the grip portion 282 is moveable between an extended position (FIG. 2) and a retracted position (FIGS. 6 and 7). In the extended position the grip portion 282 is spaced apart from the cleaning unit by an extended distance 286 (FIG. 2). In the retracted position, the grip portion 282 is generally proximate the cleaning unit 108 and is spaced apart from the upper end of the cleaning unit 108 by a retracted distance 288.

The retracted distance 288 is smaller than the extended distance 286. Optionally, the retraced distance 288 may be less than about 50% of the extended distance 286, and may be less than about 15% and/or less than about 10% of the extended distance 286.

Optionally, the handle 118 may be selectably securable or lockable in both the extended and retracted positions using any suitable locking mechanism, including, for example a clamp, clip, pin, latch or other mechanism. Preferably the handle 118 may also be securable in one or more intermediate or partially-retracted positions (FIG. 4) using the same locking mechanism or any other suitable locking or securement mechanism. In the partially-retracted position, the grip portion 282 is spaced apart from the cleaning unit 108 by an intermediate distance 290, which is less than distance 286 and greater than distance 288.

Optionally, to help provide the adjustable functionality, the handle 118 may be configured as a telescopic handle. In the illustrated example, the cleaning unit 108 has a length 292 and the telescoping handle comprises a telescopic handle shaft including an upper shaft portion 294 slidably coupled to a lower channel 296. Preferably, the lower channel 296 may be provided on the cleaning unit and may extend along at least a portion of the length 292 of the cleaning unit 108, and may extend at least 75% of the length 292.

In this configuration, the position of the grip portion 282 may be adjusted by telescoping the upper shaft portion 294 within the lower channel 296. Preferably, the upper shaft portion 294 may be substantially contained within the lower channel 296 when the grip portion 282 is in the retracted position. Optionally, when the grip portion 282 is retracted, at least 50% of the upper shaft portion 294 may be positioned within the lower channel 296 and extends along the length 292 of the cleaning unit 108. Preferably, when the grip portion 282 is retracted at least 60%, and optionally at least 75% of the upper shaft portion 294 is nested within the lower channel 296.

It will be appreciated that, depending upon the aspects that are incorporated into a surface cleaning apparatus, some of the exemplified features may not be used or may be varied so as to be of any design known in the art.

What has been described above has been intended to be illustrative of the invention and non-limiting and it will be understood by persons skilled in the art that other variants and modifications may be made without departing from the scope of the invention as defined in the claims appended hereto.

What is claimed is:

1. A reconfigurable upright surface cleaning apparatus comprising:

(a) a surface cleaning head having a first dirty air inlet;

(b) a cleaning unit comprising an air treatment member, a suction motor and a clean air outlet;

(c) the cleaning unit is movably connected to the surface cleaning head between an upright storage position and an inclined in use position, the cleaning unit is detachably connected to the surface cleaning apparatus;

(d) a reconfigurable air flow passage comprising at least one portion that is alternatively configurable between i. a surface cleaning mode in which the cleaning unit is connected to the surface cleaning apparatus and an air flow passage extends between the first dirty air inlet and the clean air outlet; and ii. an auxiliary cleaning mode in which the cleaning unit is detached from the surface cleaning apparatus, the air flow passage extends from a second dirty air inlet to the clean air outlet and a position of the second dirty air inlet is adjustable relative to the cleaning unit; and, (e) an adjustable handle extending from an upper surface of the cleaning unit and drivingly connected to the surface cleaning head, the handle comprising a grip portion having at least one grip member and being moveable between an extended position, in which the grip portion is spaced apart from the cleaning unit, and a retracted position, in which the grip portion is positioned proximate the cleaning unit.

2. The surface cleaning apparatus of claim 1, wherein the handle comprises a telescoping handle.

3. The surface cleaning apparatus of claim 2, wherein the cleaning unit has a length and the telescoping handle comprises a telescopic handle shaft including an upper shaft portion slidably coupled to a corresponding channel portion, and the channel portion extends along at least a portion of the length of the cleaning unit.

4. The surface cleaning apparatus of claim 3, wherein when the grip portion is in the retracted position at least ⅔ of the upper shaft portion extends along the length of the cleaning unit.

5. The surface cleaning apparatus of claim 1, wherein the handle is selectably securable in both the extended and retracted positions.

6. The surface cleaning apparatus of claim 1, wherein the cleaning unit is detachably connected to the surface cleaning head.

7. The surface cleaning apparatus of claim 1, wherein the grip portion is moveable between the extended and retracted positions when the cleaning unit is in each of the surface cleaning mode and the auxiliary cleaning mode.

8. The surface cleaning apparatus of claim 1, wherein the grip portion is securable in at least one intermediate position between the extended and retracted positions.

9. The surface cleaning apparatus of claim 1, wherein the air flow passage comprises at least one re-positionable conduit member having a downstream end that is in continuous air flow communication with the air treatment member and an upstream end that defines the second dirty air inlet when the cleaning unit is in the auxiliary cleaning mode and that is in air flow communication with the first dirty air inlet when the cleaning unit is in the surface cleaning mode.

10. The surface cleaning apparatus of claim 9, wherein the re-positionable conduit member comprises a flexible hose.

11. The surface cleaning apparatus of claim 9, wherein the downstream end of the re-positionable conduit member is movably coupled to the cleaning unit.

12. The surface cleaning apparatus of claim 11, wherein the downstream end of the re-positionable conduit member is rotatably coupled to the cleaning unit.

13. The surface cleaning apparatus of claim 1, wherein the handle does not form part of the air flow passage.

14. The surface cleaning apparatus of claim 1, wherein the handle extends from an upper portion of the cleaning unit and is external the air flow passage.

15. The surface cleaning apparatus of claim 1, wherein the handle further comprises a shaft member extending between the cleaning unit and the grip portion and wherein the shaft member is external the air flow passage.

16. The surface cleaning apparatus of claim 1, wherein the at least one grip member comprises a first grip member and a second grip member spaced apart from the first grip member.

17. The surface cleaning apparatus of claim 16, wherein the first grip member extends in a first direction and the second grip member extends in a second direction that is at an angle to the first direction.

18. The surface cleaning apparatus of claim 17, wherein the second grip member is oriented at an angle between about 10 degrees and about 175 degrees relative to the first grip member.

19. The surface cleaning apparatus claim 17, wherein when the surface cleaning apparatus is in the upright position the second grip member is generally vertical and the first grip member is within about 30 degrees of horizontal.

20. The surface cleaning apparatus of claim 17, wherein the second grip is provided on a rear portion of the handle and is generally vertical when the cleaning unit is in the upright position.

21. A reconfigurable upright surface cleaning apparatus comprising:

(a) a surface cleaning head having a first dirty air inlet;

(b) a cleaning unit comprising an air treatment member, a suction motor and a clean air outlet;

(c) the cleaning unit is movably connected to the surface cleaning head between an upright storage position and an inclined in use position, the cleaning unit is detachably connected to the surface cleaning apparatus;

(d) a reconfigurable air flow passage comprising at least one portion that is alternatively configurable between i. a surface cleaning mode in which the cleaning unit is connected to the surface cleaning apparatus and an air flow passage extends between the first dirty air inlet and the clean air outlet; and ii. an auxiliary cleaning mode in which the cleaning unit is detached from the surface cleaning apparatus, the air flow passage extends from a second dirty air inlet through a tangential inlet in a sidewall of the cleaning unit to the clean air outlet and a position of the second dirty air inlet is adjustable relative to the cleaning unit; and, (e) an adjustable handle provided on the cleaning unit and drivingly connected to the surface cleaning head, the handle comprising a grip portion having at least one grip member and being moveable between an extended position, in which the grip portion is spaced apart from the cleaning unit, and a retracted position, in which the grip portion is positioned proximate the cleaning unit.

22. The surface cleaning apparatus of claim 21, wherein the handle comprises a telescoping handle.

23. The surface cleaning apparatus of claim 22, wherein the cleaning unit has a length and the telescoping handle comprises a telescopic handle shaft including an upper shaft portion slidably coupled to a corresponding channel portion, and the channel portion extends along at least a portion of the length of the cleaning unit.

* * * * *